United States Patent [19]

Davis

[11] 4,164,275

[45] Aug. 14, 1979

[54] UTILITY BAG—BEACH MAT

[76] Inventor: Yvette L. Davis, 105 Oak Ave., Kentfield, Calif.

[21] Appl. No.: 915,659

[22] Filed: Jun. 15, 1978

[51] Int. Cl.[2] ..... A45C 9/00

[52] U.S. Cl. ..... 190/2; 5/417; 190/42

[58] Field of Search ..... 190/2–42; 5/344

[56] References Cited

U.S. PATENT DOCUMENTS

| | | | |
|---|---|---|---|
| 1,420,782 | 6/1922 | Suski | 190/2 |
| 1,805,415 | 5/1931 | Pendarvis | 190/2 |
| 2,540,165 | 2/1951 | Fiel | 190/42 |
| 3,514,796 | 6/1970 | Dibrell | 5/344 X |

FOREIGN PATENT DOCUMENTS

| | | | |
|---|---|---|---|
| 143163 | 10/1935 | Austria | 5/344 |

*Primary Examiner*—Donald F. Norton
*Attorney, Agent, or Firm*—Melvin R. Stidham

[57] ABSTRACT

A utility bag-beach mat wherein a mat of straw or the like is an integral part of a bag, which when folded, functions as a relatively rigid stiffener and support for articles carried thereon. In one embodiment, points on the side edges of the mat are drawn together to form a pouch to accommodate the ends of the mat, as well as other articles to be carried. In another embodiment, a utility bag has a front panel which folds down to enable a mat, which is attached at the bottom panel, to be rolled out. A lid is formed in two panels, with the outer panel being folded under when the bag is being carried. When at the picnic site, and the front panel is dropped, the lid may be extended so that zippers may be moved down transition tracks to the bottom panel and then along its forward edges to meet in the middle.

9 Claims, 9 Drawing Figures

UTILITY BAG—BEACH MAT

BACKGROUND OF THE INVENTION

It is a favorite recreational activity of people of all ages to spend a day at the beach or park to sunbathe, swim, play games and otherwise enjoy the fresh air and sunshine. However, the trip to and from the beach and park may be quite another thing because of the difficulty in transporting all of the paraphenalia to be utilized in the day's activities. For example, a person may wish to carry a beach mat for sunbathing, towels, suntan lotions, sunglasses, change of shoes and perhaps other clothing as well as sports and recreational equipment. Then, when the sunbather wishes to leave the beach mat, as to go swimming, it is desirable to have a relatively safe place to put items of jewelry as well as money, just as it is desirable to have such valuables out of view should one fall asleep while sunbathing.

OBJECTS OF THE INVENTION

It is an object of this invention to provide a beach bag to accommodate a beach mat as well as a wide assortment of beach and picnic articles.

It is a further object of this invention to provide a utility bag from which a beach mat may be unfolded and the bag closed again.

It is a further object of this invention to provide a beach mat with attached container for valuables and other articles.

It is a further object of this invention to provide a means for carrying a beach mat, clothing and other articles easily.

Other objects and advantages of this invention will become apparent from the description to follow, particularly when read in conjunction with the accompanying drawing.

SUMMARY OF THE INVENTION

In carrying out this invention, I provide a bag of fabric or the like which is long enough to accommodate the width of a straw beach mat. The bottom, sides and back panel of the bag are unitary construction and a front panel is hinged to the front edge of the bottom panel and releasably secured along its side edges to the sides by means of slide fasteners. A lid is formed in two panels, and when carrying the bag, the outer or distal panel is folded under and the lid secured in place as by slide fasteners along the side edges engaging also along the top edges of the side panels, and/or by a tab which may be snapped to the top of the front panel. A continuous loop handle is sewn to the front and rear panels and under and to the bottom panel along spaced lines for maximum support and easy carrying. At the beach, the front panel is released by unzipping along the sides and a straw mat which is attached at a junction between the front and bottom panels is unfurled. Then, the two panels of the lid may be unfolded and the zippers along the sides again attach it to the tops of the side panels then down curving transition tracks and across the leading edge of the bottom panel, where the two zippers slide from opposite sides and are secured together at approximately the mid point of the head of the beach mat. Thus, there is formed an enclosure for valuables and personal effects which is integrally secured to the beach mat.

In an alternative embodiment strings or the like are secured at spaced points along the side edges of a straw mat, so that when drawn together they form a panel to accommodate the end portions of the mat, as well as articles to be carried. The drawstrings are threaded through fabric end panels. Again, a continuous loop handle is provided.

DESCRIPTION OF A PREFERRED EMBODIMENT

Figures 1, 2, 3, 4, 4A, 5:
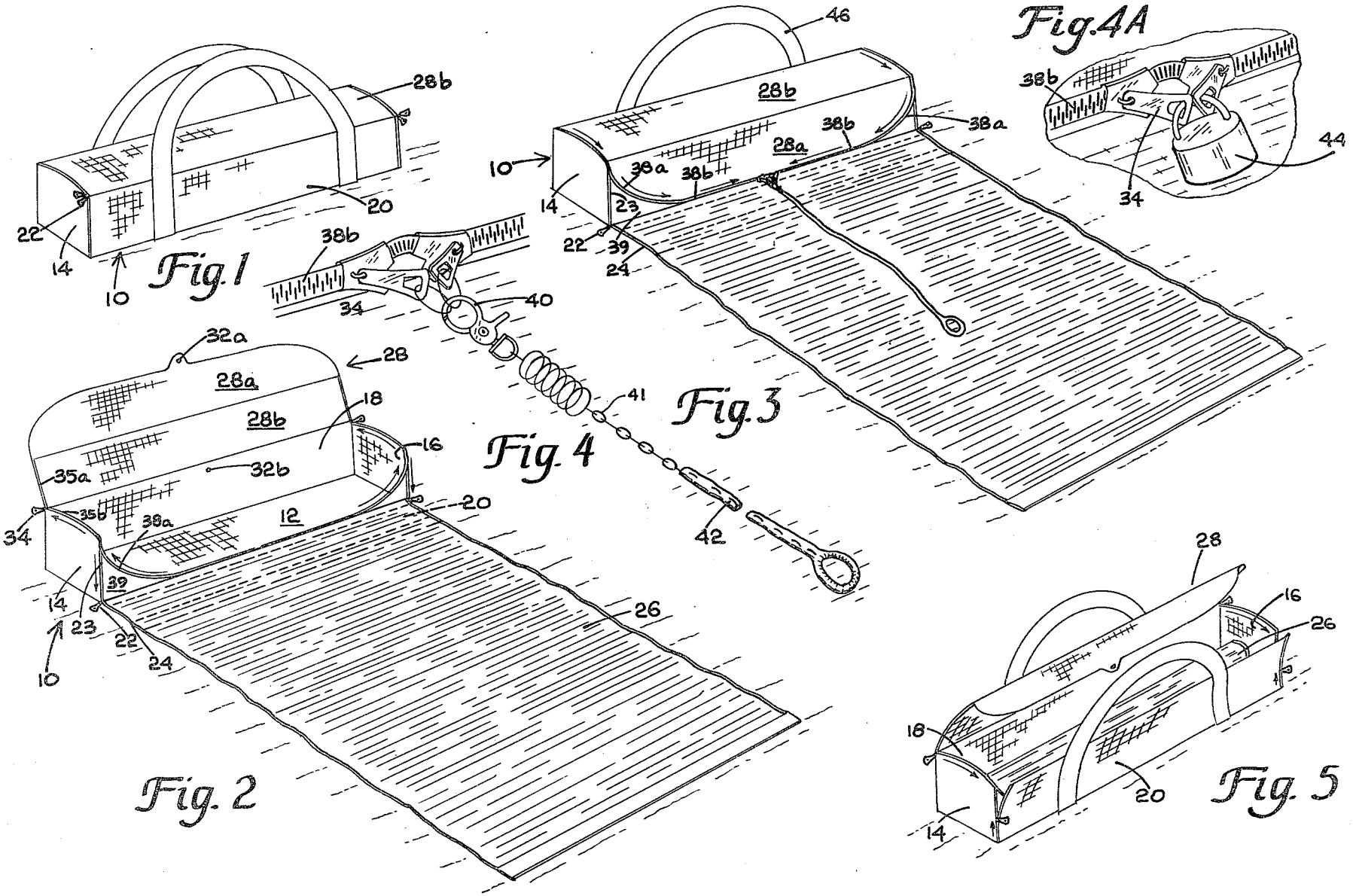
FIG. 1 is a view in perspective of the utility bag of this invention conditioned for carrying.
FIG. 2 is a view in perspective of the bag open with beach mat unfurled.
FIG. 3 is a view in perspective of a beach mat unfurled and bag reclosed.
FIGS. 4 and 4A are enlarged partial views of means for securing the bag while at the beach.
FIG. 5 is a view perspective of the bag partially reclosed.

The Embodiment of FIGS. 1 to 5

Referring now to the drawing with greater particularity, the utility or beach bag 10 of this invention includes a bottom panel 12, side panels 14 and 16 and a back panel 18 preferably of a suitable fabric, such as denim, and stitched together in unitary construction. Hingedly connected to the bottom panel 12 is a front panel 20 which is releasably secured to the side panels, as by means of slide fasteners 22 which engage complimentary fastening teeth 23 and 24 on the sides and front, respectively, to convert from the assembled position shown in FIG. 1 to the open position of FIG. 2 from which a beach mat 26 of straw or fabric may be unfurled, the mat being secured to the front panel 20, the bottom panel 12 or the junction therebetween.

A lid 28 in two panels **28*a* and 28*b* is hingedly connected at 30 to the back panel 18, and for carrying, the panel 28*a* is folded under the panel 28*b* and secured by engagement of a snap or the like 32*a* to a complimentary snap 32*b* on the back panel. Then, the cover is folded down to the position shown in FIG. 1 and secured in place by engagement of slide fasteners 34 on tracks 35*a* and 35*b* on the lid panel 28*a* and the sides 14, 16**, respectively.

Transition slide tracks **38*a* carried on gusset panels 39 form a continuation of the top tracks 35*b* and merge into lateral tracks 38*b* along the hinge line joining the bottom and front panels 12 and 20. Hence, when the lid 28 is closed to the position shown in FIG. 3 with the mat 26 unfurled, the slide fasteners 34 may be run along the tracks down and along tracks 38*a* and then laterally across the bottom tracks 38*b* to close the container tightly and secure personal effects while at the beach. If desired, as shown in FIG. 4 the slide fasteners 34 may be interengaged by a hook or loop 40 on a chain 41 which may be encased in a fabric sheath 4 so that it may be disposed under the towel and body of the person sunbathing. Hence, entry to the utility bag is impossible even though the person is asleep. As an alternative, the zippers 34 may be secured together by a lock 44, as shown in FIG. 4A**.

For carrying purposes, I provide a continuous loop handle 46 which is stitched to the front 20, bottom 12 and back panels 18 for maximum support. As indicated, the loop segments are rather wide spread for maximum balance whereby the bag 10 fully packed may easily be carried with one hand.

When the mat 26 is folded into the bottom of the bag, as shown in FIG. 5, it lends rigidity to the bottom 12 to facilitate support of other articles thereon.

Figure 6:
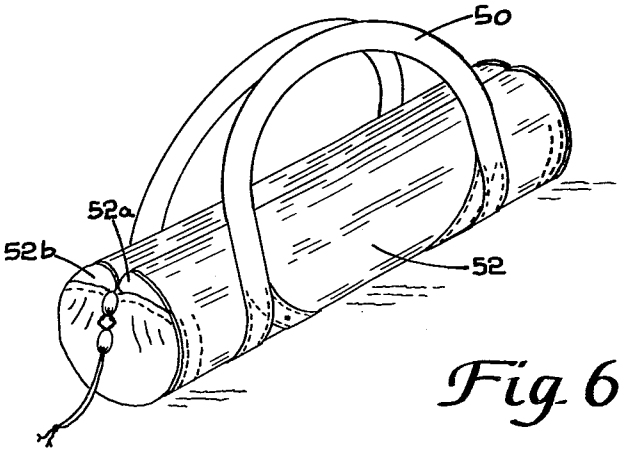
FIG. 6 is a view in perspective of another embodiment of this invention conditioned for carrying.
Figure 8:
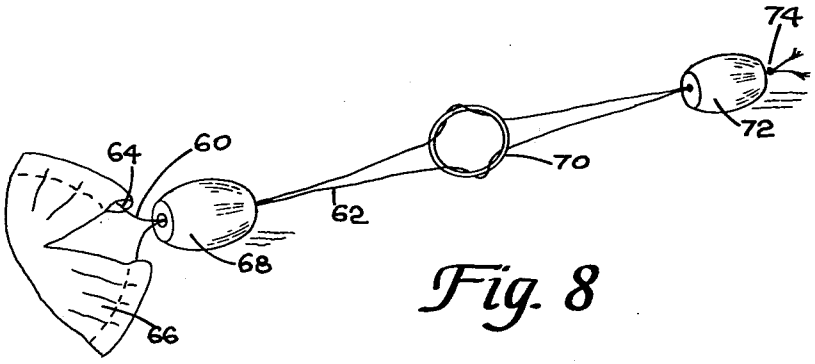
FIG. 8 is a partial view in perspective of the drawstring arrangement of this embodiment.
Figure 7:
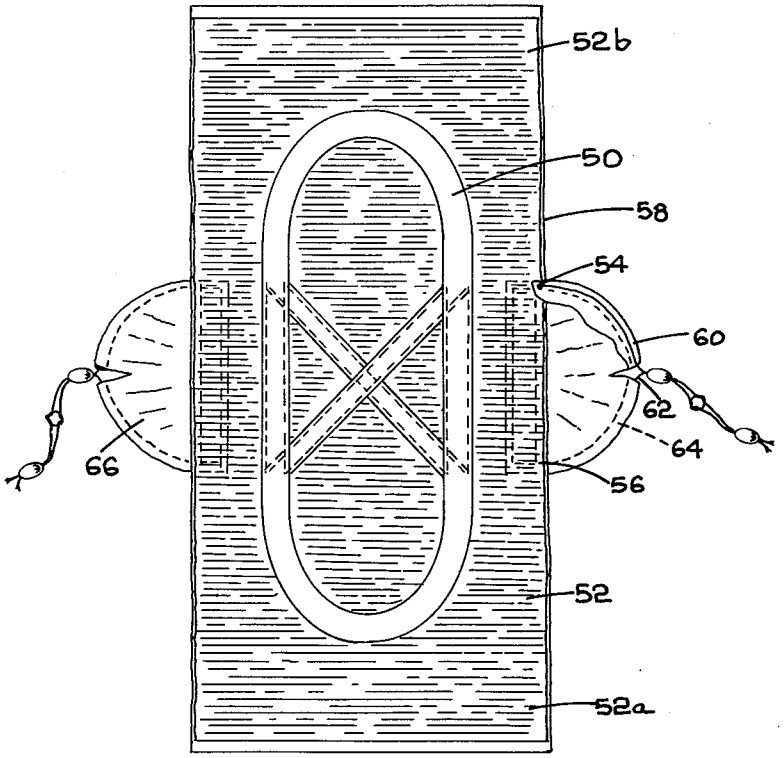
FIG. 7 is a top view of the bag of FIG. 6 unfurled.

The Embodiments of FIGS. 6 to 8

In this embodiment, a complete loop carrying handle 50 is fixed directly to the face of a beach mat 52 of straw or the like with criss-cross reinforcing members being stitched, if desired.

Also secured at spaced points 54 and 56 along the side edges 58 of the beach pad 52 are drawstrings 60 and 62 threaded through the hems 64 of generally semi-circular end panels 66 of a relatively soft, pliable fabric.

As shown in FIG. 8, the drawstrings are threaded through a bead 68 then through, around and back through a ring 70, and finally, through another bead 72, behind which they are knotted together at 74.

In operation, the drawstrings 60 and 62 may be pulled together to draw the points 54 and 56 on the side edges of the mat 52 closer together to the configuration of FIG. 6 wherein they form a pouch. Then, the bead 68, the ring 70 and the bead 72 are, in turn, slid along the strings 60 and 62 to lock the structure in pouch form wherein it is easily carried by grasping the continuous loop handles 50.

The end portions **52*a* and 52*b* of the mat 52** may be furled and folded into the pouch so formed. Other articles may be carried as well.

While this invention has been described in conjunction with a preferred embodiment thereof, it is obvious that modifications and changes therein may be made by those skilled in the art without departing from the spirit and scope of this invention, as defined by the claims appended hereto.

What I claim as invention is:

1. A utility bag comprising bottom, back and two side panels of unitary construction;

a front panel;

first means (23, 24) for releasably securing the sides of said front panel to said side panels;

a lid hinged to said back panel;

second means (**35*a*, 35*b***) for releasably securing said lid to close against said front panel; and a mat of a size to accommodate a person thereon;

one end of said mat being secured to one of said front and bottom panels.

2. The utility bag defined by claim 1 including wherein:

said second means releasably secures the sides of said lid to said side panels.

3. The utility bag defined by claim 1 wherein said lid comprises:

first and second lid panels hinged together;

said second means releasably securing the sides of said first lid panel to the tops of said side panels; and including:

third means (**38*a***) for attaching sides of said second lid panel to said side panels when said first securing means are unattached.

4. The utility bag defined by claim 3 including:

fourth means (**32*a***) for releasably securing said second lid panel in a position underlying said first lid panel.

5. The utility bag defined by claim 3 including:

other releasable means (**38*b***) for securing the outer edge of said second lid panel to the front edge of said bottom panel when said first means are unattached.

6. The utility bag defined by claim 5 wherein said second releasable means includes a main slide fastener on each side of said lid; and complementary engagable tracks along the sides of said lid and the tops of said side panels; and said other releasable means comprises:

gusset panels interconnecting said side panels and the front edge of said bottom panel;

a slide fastener track secured along the edges of said gusset panels forming a continuation of said side panel top tracks and continuing across the front of said bottom panel;

complementary fastener tracks along the sides and outer edge of said second lid panel mutually engageable by said main slide fasteners.

7. The utility bag defined by claim 6 including:

means for securing said main slide fasteners together when in fully engaged position.

8. The utility bag defined by claim 1 including:

a continuous loop carrying strap secured to said front and back panels and extending under said bottom panel.

9. The utility bag defined by claim 1 wherein:

said first releasable means comprises complementary slide fastener means along the side edges of said front panel and the front edges of said side panels.

* * * * *